United States Patent [19]

Engle

[11] 4,350,528

[45] Sep. 21, 1982

[54] METHOD FOR DIFFUSION BONDING WORKPIECES AND ARTICLE FABRICATED BY SAME

[75] Inventor: Edgar W. Engle, Rogers, Ark.

[73] Assignee: TRW Inc., Cleveland, Ohio

[21] Appl. No.: 158,761

[22] Filed: Jun. 12, 1980

[51] Int. Cl.[3] ..... B22F 7/02

[52] U.S. Cl. ..... 75/203; 75/204; 75/208 R

[58] Field of Search ..... 75/208 R, 203, 204; 428/565

[56] References Cited

U.S. PATENT DOCUMENTS

| | | | |
|---|---|---|---|
| 3,123,471 | 3/1964 | Marshall | 75/208 R |
| 3,551,991 | 1/1971 | Reich et al. | 75/208 R |
| 4,108,652 | 8/1978 | Ogawa et al. | 75/208 R |

*Primary Examiner*—Allan Lieberman

*Attorney, Agent, or Firm*—Daniel G. Blackhurst

[57] ABSTRACT

A diffusion bonding method for assembling members formed from a liquid phase system material into a monolythic structure free of flaws and distortion. Member blanks are first formed from the material as by compacting or the like and then sintered to have their full density and hardness characteristics. Following sintering, any special surface or internal features are machined into the blanks to define the members. The members are also provided with bonding surfaces adapted to be placed in mating engagement with each other. The members are placed in an assembled relationship with the bonding surfaces engaging each other to define a bonding zone. In some cases, it may also be desirable to place a weight on the assembled members to continuously urge the bonding surfaces toward engagement. In the actual bonding step, the members are heated in a vacuum environment to a temperature intermediate the melting temperatures of the material low and high melting phase components. During such heating, the liquid phase system material of the two members coalesce across the boundary zone to effect an integral joint or bond.

12 Claims, 7 Drawing Figures

FIG. 1
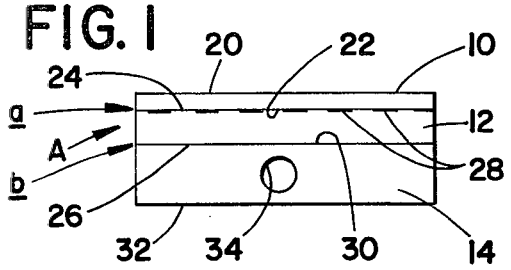
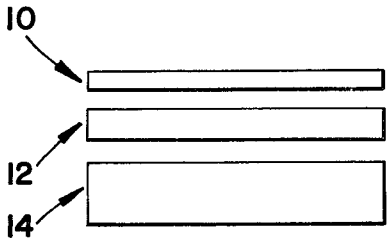
FIG. 2
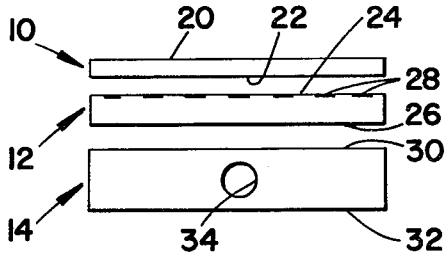
FIG. 3
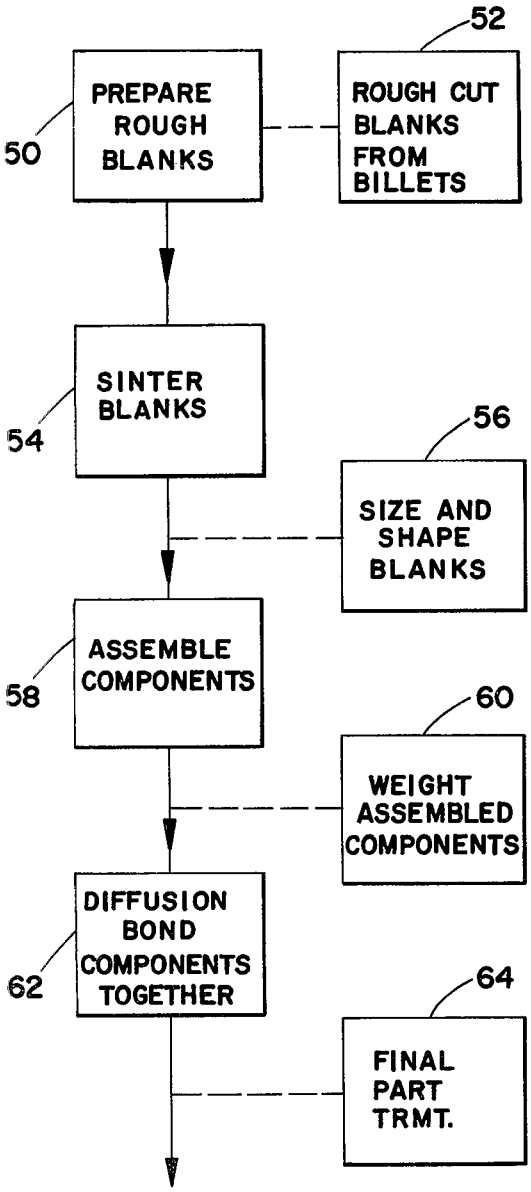
FIG. 4

FIG. 5
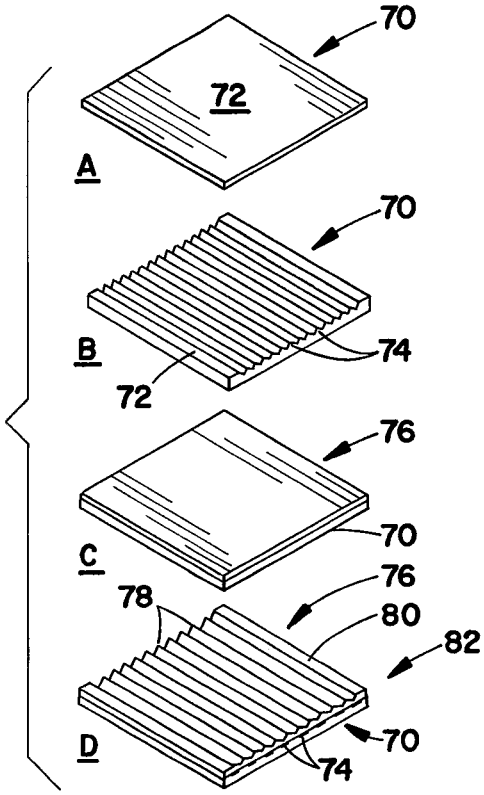
FIG. 6
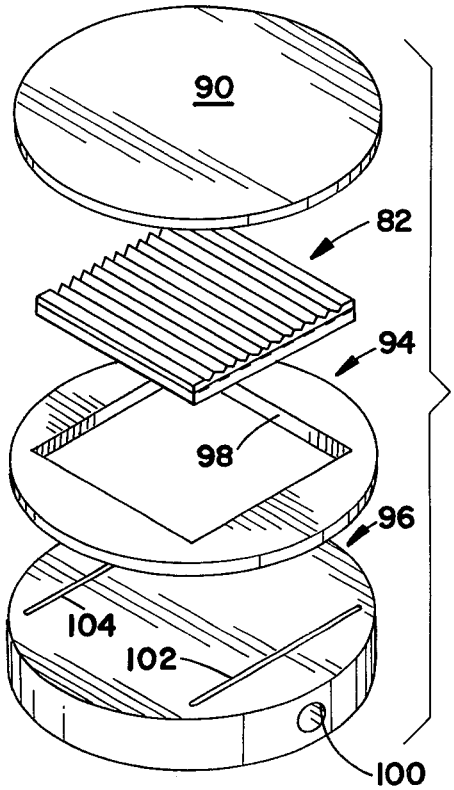
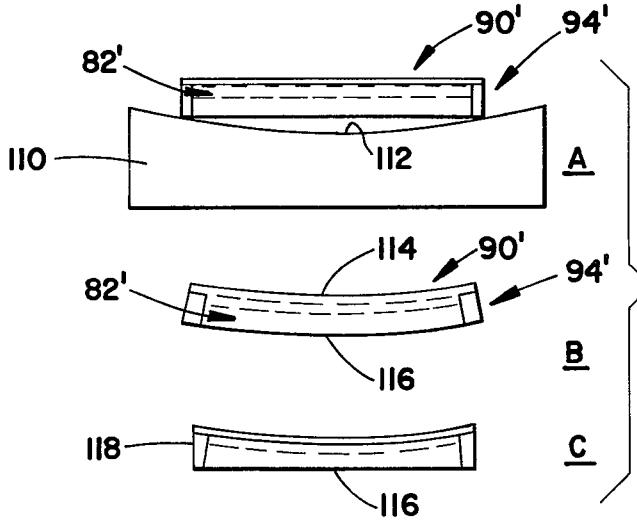
FIG. 7

METHOD FOR DIFFUSION BONDING WORKPIECES AND ARTICLE FABRICATED BY SAME

BACKGROUND OF THE INVENTION

This application pertains to the art of bonding or joining and more particularly to integrally bonding at least a pair of workpieces to each other.

The invention is particularly applicable to use with workpieces formed from a liquid phase system material such as cemented carbide, including cemented tungsten carbide and the like, and will be described with particular reference thereto. However, it will be appreciated that the invention has far broader applications and is deemed equally applicable to other types of liquid phase system materials.

Cemented carbide materials are formed into various shapes and configurations by techniques associated with the art of powder metallurgy. These techniques are well known and generally involve the process of consolidating metal powders into ingots or shaped parts without fusion or at least without fusion in the major portion of the powder components. Typically, the procedure involves pressing or compacting the powder into some desired shape and then heating or sintering the compact at a temperature below the melting point of its highest melting point constituent. It is known that cemented carbide pieces or members will stick to each other if placed in contact during the sintering operation.

It is often desired to fixedly interconnect a plurality of sintered carbide components to each other so as to define a subassembly or some finished article. Heretofore, such interconnections have been accomplished by several means including brazing and bonding under elevated temperature-pressure conditions. In such bonding, the temperature involved is approximately the same as that for sintering and the pressure is approximately in the range of 1000 psi or so. However, the resultant bonds were not entirely satisfactory and the process itself did not accommodate joining members which included intricate designs such as ducts, passages, grooves and the like.

One particular situation where the foregoing problems are apparent is in the manufacture of optical elements or mirrors which are utilized for high energy laser applications. The performance of high energy lasers is greatly influenced by the configuration of the optical elements involved. Small distortions of the optical surfaces may severely degrade the laser beam coherence and therefore, reduce its effectiveness. The mirrors themselves generally involve a configuration comprised of a plurality of components including a mirror surface or faceplate and a heat exchanger. These components include intricate configurations and/or relationships and must be fixedly secured to each other in the final mirror structure.

At the present time, mirrors and other optical elements for high energy laser applications are conventionally made from molybdenum. Such constructions are, however, approaching their limit of low distortion under high laser beam power density. Accordingly, it has been proposed to construct such mirrors from cemented tungsten carbide since it has about the same thermal conductivity as molybdenum, a lower coefficient of thermal expansion and a much higher modulus of elasticity. As a result, tungsten carbide is considered to be inherently better for low distortion mirror applications than molybdenum. However, to successfully manufacture or fabricate mirrors from the material adapted for laser applications, it has been necessary to develop a process or system whereby the various mirror components could be assembled into a monolythic structure free of flaws and distortion. The method or system should also readily accommodate joining components which include intricate designs without in any way damaging or impairing the designs during bonding or joining.

The subject invention provides a method or system which meets the foregoing needs and overcomes problems encountered with prior known bonding techniques employed for fixedly securing cemented carbide members to each other. In addition, and while application of the invention will hereinafter be specifically described with reference to a cemented tungsten carbide mirror construction, the invention is deemed broadly and equally applicable to joining or bonding other types of components or members formed from various liquid phase system materials adapted to use in other applications and/or environments.

BRIEF DESCRIPTION OF THE INVENTION

In accordance with the present invention, there is provided a method of diffusion bonding or joining at least a pair of members which are compacted from liquid phase system materials which include low melting phase components and high melting phase components and wherein each member has been sintered for obtaining substantially the full density and hardness thereof. The method involves the step of placing the members in an assembled relationship with a first bonding or joining surface on one of the members in mating engagement with a second bonding or joining surface on the other of the members to define a bonding or boundary zone. Thereafter, the step of heating the members in the assembled relationship is employed. This heating is to a temperature intermediate the melting temperatures of the low and high melting phase components of the members for coalescence of the members across the bonding zone and to effect an integral interconnection therebetween. In other words, the heating step causes a grain growth between the two members across the bonding zone at least adjacent the first and second bonding surfaces.

According to another aspect of the method, a separate step of preparing the first and second bonding surfaces is included. This step assures mating engagement between the surfaces when the members are placed in their assembled relationship.

In accordance with yet another aspect, the method includes the step of applying a pressure to the members at least during the step of heating for continuously urging the first and second bonding surfaces into close mating engagement with each other. For some bonding surface configurations and finishes, applying pressure will enhance the diffusion bond across the bonding zone.

The step of preparing further includes shaping or machining any desired special or intricate conformations or designs into the members themselves. Such shaping or machining is performed subsequent to sintering and prior to the step of heating.

The preferred application of the method is to members or components formed from cemented carbide materials and, more particularly, from cemented tungsten carbide.

In accordance with still a further aspect of the invention, an article or workpiece is provided and advantageously formed from liquid phase system material which includes low melting phase components and high melting phase components. The article includes at least a pair of article members which have been compressed from articles of the system material and sintered to generally have their full density and hardness characteristics. A bonding surface is included on each of the article members and configured to substantially mate with each other for defining a boundary zone when the members are placed in their desired assembled relationship. An integral interconnection between the members is provided across the boundary zone. This interconnection is effected by heating the components in their assembled relationship to a temperature intermediate the melting temperatures of the system low and high melting phase components. Such heating causes a coalescence or grain growth between the two members across the boundary zone at least adjacent the mounting surfaces.

The principal object of the present invention is the provision of a new method for diffusion bonding or joining members or workpieces and an article fabricated by the method.

Another object of the invention is the provision of such a method and article in which distortion of the component members is eliminated or at least substantially reduced at an area of interconnection therebetween.

Anther object of the invention is the provision of a new bonding method and article which may be readily adapted to use with a wide variety of different liquid phase system materials and for a wide variety of member or article configurations used in any number of different environments.

Still other objects and advantages for the invention will become apparent to those skilled in the art upon a reading and understanding of the following specification.

BRIEF DESCRIPTION OF THE DRAWINGS

The invention may take physical form in certain parts and arrangements of parts, preferred and alternative embodiments of which will be described in detail in this specification and illustrated in the accompanying drawings which form a part hereof and wherein:

FIG. 1 is a generally schematic side elevational view of a laser mirror formed in accordance with the present invention;

FIG. 2 is an exploded view of the mirror components in their rough formed condition subsequent to sintering;

FIG. 3 is a view similar to FIG. 2 showing the components following sizing and shaping thereof prior to application of the subject new bonding process;

FIG. 4 is a block diagram generally showing the steps contemplated in practicing the subject new method;

FIG. 5 is a generally perspective view which sequentially shows the steps involved in forming one type of heat exchanger for a laser mirror utilizing the concepts of the subject invention;

FIG. 6 is an exploded perspective view showing the basic mirror components which incorporate the heat exchanger arrangement of FIG. 5 and which mirror is assembled using the concepts of the subject invention; and, FIG. 7 is a generally schematic view which sequentially shows the steps for obtaining some predetermined curvature in the mirror heat exchanger and faceplate.

DETAILED DESCRIPTION OF THE PREFERRED AND ALTERNATIVE EMBODIMENTS

Referring now to the drawings wherein the showings are for purposes of illustrating preferred and alternative arrangements of the invention only and not for purposes of limiting same, FIG. 1 shows a mirror construction A particularly suited for high energy laser applications and which mirror has been formed and/or assembled in accordance with the concepts of the present invention. While the invention will be described in detail with reference to such mirror as well as variations thereof, it will be readily appreciated by those skilled in the art that the invention has broader applications and may be utilized for integrally joining any number of separate components to each other for a wide variety of uses or applications. Moreover, and while the mirror construction will be specifically described with reference to cemented tungsten carbide, it will also be appreciated that the invention is fully applicable to use with other cemented carbide materials as well as in other types of liquid phase systems.

More particularly, mirror A is comprised of three basis sections which are integrally joined with each other pursuant to the new bonding method. These sections comprise faceplate 10, a heat exchanger 12 and a substrate or base 14 which are compatible with each other and which may have generally circular, rectangular or square configurations. Faceplate 10 includes a planar outer or mirror surface 20 with a planar inner surface 22. Heat exchanger 12 includes spaced apart parallel upper and lower planar surfaces 24,26. Upper surface 24 includes a plurality of spaced apart coolant flow channels 28 therein which are advantageously employed to acommodate coolant flow therethrough at least during high energy laser applications. Substrate or base 14 includes spaced apart parallel upper and lower planar surfaces 30,32. The substrate or base may conveniently and advantageously include internal passages or the like to reduce the substrate weight and/or to facilitate flow communication with heat exchanger coolant flow channels 28. One such passage is schematically shown in FIG. 1 and designated by numeral 34. Insofar as the details of the subject invention are concerned, faceplate 10, heat exchanger 12 and substrate or base 14 are integrally interconnected at surfaces 22,24 and surfaces 26,30 which define bond or boundary zones a,b, respectively.

Referring more particularly to FIGS. 2, 3 and 4, description will hereinafter be made to the detals of the mirror construction of FIG. 1, including the specifics of the diffusion bonding or joining process. In FIG. 4, the first step is designated by numeral 50 and comprises preparing rough blanks for ultimate processing into the faceplate, heat exchanger and substrate components described above. These blanks may be individually prepared by compacting tungsten carbide powder mixed with cobalt powder. Specifically, the mirror described above has been constructed from two different grades of cemented tungsten carbide, namely one having 6% cobalt and another having 9% cobalt. In processing cemented tungsten carbide to form blanks for the mirror components, conventional powder metallurgy techniques are employed wherein the tungsten carbide powder comprises a high melting phase component and the cobalt comprises a low melting phase component. Since such processing techniques are well known in the art, a detailed discussion thereof has not been included. An acceptable alternative to individually preparing the rough blanks is to press or compact the cemented tungsten carbide material into a billet and then rough cut or saw the individual mirror components therefrom. This alternative is shown in FIG. 4 and designated by numeral 52.

The blanks are then sintered as indicated by method step 54 in FIG. 4. Such sintering is performed in a vacuum oven or furnace to obtain substantially the full blank density and hardness and with the blanks arranged in a non-contacting relationship with each other. During sintering, and for the specific cemented tungsten carbide materials which have been utilized for the mirror construction, a linear shrinkage of approximately 17% or so for each blank will be involved. The sintering temperature and vacuum conditions utilized are conventional for the particular material employed. Following sintering, the blanks which comprise faceplate 10, heat exchanger 12 and substrate 14 will have the general configurations shown in FIG. 2.

Because the overall mirror construction requires certain intricate structural conformations in the individual components, it is necessary to next size and shape the blanks as indicated by step 56 in FIG. 4. Such sizing and shaping is typically accomplished by grinding or other appropriate material removal operations and will, with reference to FIG. 3, include formation of coolant flow channels 28 in heat exchanger upper surface 24 and the necessary and desirable passages or channels 34 in substrate or base 14. In addition, it is desirable that inner and upper surfaces 22,24 and lower and upper surfaces 26,30 be machined in a manner so that they will substantially matingly cooperate for defining bond zones a,b (FIG. 1) when the mirror components are placed in an assembled relationship. A precise mating relationship is preferred since the joining process involves grain growth or coalescence across the bonding zones as will become more readily apparent hereinafter.

The sizing and/or shaping steps required for the blanks as indicated by numeral 56 in FIG. 4 are a function of the particular workpiece and blanks involved and the particular physical and/or dimensional characteristics required therefor in order to satisfactorily meet an intended use. Thus, for some members or components which are carefully prepared in the blank stage, no sizing and/or shaping steps may be required.

The components are next cleaned, assembled and placed in a vacuum oven or furnace for diffusion bonding in accordance with the process of the invention. This step is indicated by numeral 58 in FIG. 4. In the case of laser mirror A, such assembly merely comprises stacking the components relative to each other in their final desired relationship with surfaces 22,24 and surfaces 26,30 in engagement with each other to define bonding zones a,b. Depending on the precise nature of the mating relationship between these cooperating surfaces, it may be desirable to slightly weight the assembled components for continuously urging surfaces 22,24 and surfaces 26,30 into enagement.

For the particular cemented tungsten carbide materials used in fabricating laser mirror A of FIG. 1, the carbide block or the like is employed and simply placed on outer surface 20 of faceplate 10. While the specific weight desired will vary as a function of the surface finish and mating relationship between the cooperating surfaces, a normal weight or unit pressure in the range of 0–480 gms/in$^2$ of bonding zone area at either of zones a,b is typically employed for laser mirror A. However, improvement of the mating relationship between surfaces 22,24 and surfaces 26,30 allows this weight or unit pressure to be substantially reduced or even entirely eliminated.

As previously noted, cooperating surfaces 22,24 and 26,30 define bonding zones or boundaries a,b. In accordance with the present invention, faceplate 10, heat exchanger 12 and substrate or base 14 are diffusion bonded together at these bond zones as indicated by the method step 62 in FIG. 4. This diffusion bonding is achieved by heating the assembled components in a vacuum furnace to a temperature generally in the range of the sintering temperature, i.e., intermediate the melting tempertures of the material low and high melting phase components. It has been found that for laser mirror A fabricated from cemented tungsten carbide having 6% or 9% cobalt, a diffusion bonding temperature in the range of 1380° C.–1480° C. is particularly preferred. Such temperatures are above the melting temperature for the low melting phase component of cobalt, i.e., 1300° C. for fine grain sizes, and below the temperature where there is massive melting, i.e., approximately 1490° C. It is also considered desirable to perform the bonding process at a temperature which is more closely spaced toward the lower range of melting temperatures for the low melting phase component.

In addition, the diffusion bonding is preferably performed in a vacuum environment. While the precise vacuum condition may vary somewhat as a function of the heating furnace capabilities, a vacuum of less than 750 microns at the bonding temperature is desired for the particular mirror construction involved. A vacuum in the range of approximately 200 microns or so is generally preferred. Here also, these parameters may be varied somewhat as deemed necessary and/or appropriate to suit a particular bonding situation or application. For example, a controlled hydrogen atmosphere environment may be satisfactorily employed.

During heating to secure diffusion bonding, grains in faceplate 10 and heat exchanger 12 at least adjacent surfaces 22,24 thereof and grains in heat exchanger 12 and substrate 14 at surfaces 26,30 thereof grow across the bonding zones a,b (FIG. 1) defined thereby. Thus, there is complete coalescence of the faceplate, heat exchanger and substrate components at least across their cooperating bonding zones or boundaries so that the components thereof are joined or bonded in an integral relationship. Indeed, photomicrographs of a cross-section in a laser mirror A following diffusion bonding reveals that such grain growth or coalescence is so complete that it is virtually impossible to determine where the original bond zones or boundaries were defined between the individual components. Since the individual component blanks are sintered prior to the diffusion bonding step for obtaining full density and hardness in the blanks, there is no further shrinkage or distortion in the resultant components at the time of bonding. This result is extremely advantageous for the laser mirror application in that any distortion may severely degrade laser beam coherence and reduce its effectiveness when the mirror is placed into use.

Following diffusion bonding, any final part treatments may be performed as indicated by the step designated 64 in FIG. 4. In the case of the laser mirror, such final treatments would include polishing faceplate outer or mirror surface 20 (FIG. 1) to obtain the necessary optical characteristics. In the event the faceplate has any defects and cannot be polished to the desired finish, it may be coated by chemical vapor deposition using known techniques of a thin layer of pure tungsten which has good polishing properties. Of course, other final treatment steps may be required and/or desired for other types of components, parts and the like formed from other liquid phase system materials and bonded together in accordance with the diffusion bonding process of the subject invention.

FIG. 5 schematically shows the sequence of steps involved in forming a subassembly using the subject invention and wherein the subassembly is to later become a part of a larger assembly or article. In FIG. 5, step A shows a heat exchanger blank 70 which has already been sintered and includes a planar upper surface 72. In step B a plurality of coolant flow channels 74 are ground or otherwise machined into upper surface 72 so as to be disposed in a side by side generally parallel relationship with each other. Thereafter, in step C, a second blank 76 which has been previously sintered and prepared is placed on top of blank 70 so as to cover upper surface 72 and provide a top surface for coolant flow channels 74. Blanks 70,76 are diffusion bonded to each other in the manner hereinabove described with reference to FIG. 4. Following joining, step D shows a final treatment step wherein a plurality of coolant flow channels 78 are ground in second blank upper surface 80 in a parallel spaced apart relationship. The structure shown in step D thus comprises a double pass heat exchanger subassembly 82.

FIG. 6 shows an exploded perspective view of the circular laser mirror construction which includes heat exchanger 82 as a subassembly thereof. More particularly, the mirror shown includes a face plate 90, heat exchanger 82, a heat exchanger frame 94 and a substrate or base 96. Frame 94 includes a square center opening 98 adapted to receive and provide support for heat exchanger 82 while accommodating coolant flow through the heat exchanger. Substrate 96 includes side wall passages or the like with one such passage generally designated 100. At least some of these passages appropriately communicate with inlet and outlet manifolds 102,104 which, in turn, communicate with the heat exchanger in the final mirror assembly.

In assembling the mirror construction of FIG. 6, heat exchanger assembly 82 and frame 94 may first be bonded together utilizing the diffusion bonding concepts of the subject invention so that the heat exchanger is retained within frame opening 98. Thereafter, face plate 90, heat exchanger 82 with frame 94 and substrate 96 may be advantageously diffusion bonded together. The arrangement of FIG. 6 demonstrates the versatility of the subject new bonding method for use in joining subassembly components and for then joining the subassembly components into a final article.

Finally, FIG. 7 sequentially demonstrates further versatility in using the subject bonding method as demonstrated in obtaining a concave or convex mirror construction. For ease of illustration, like components are identified by like numerals with a primed (') suffix and new components are identified by new numerals.

To obtain heat exchanger and face plate concavity, flat face plate 90', heat exchanger 82' and frame 94' are diffusion bonded together as previously described. In step A of FIG. 7, the subassembly is located on a die 110 which has a die surface 114 of a desired spherical curvature. For the particular cemented tungsten carbide material employed for the laser mirrors described herein, the die is constructed from graphite.

The die and mirror components are then heated to the sintering temperature of the components and at this temperature, face plate 90', heat exchanger 82' and frame 94' become soft enough to sag into the graphite mold under the influence of gravity alone. As shown in part B of FIG. 7, such sagging causes outer or mirror surface 114 of faceplate 90' to assume a concave conformation substantially similar to that of die surface 112. Since the individual components have been previously sintered to substantially their full density and hardness and then diffusion bonded together, the step of reheating to obtain curvature does not in any way cause distortion in the components involved.

Finally, step C of FIG. 7 shows this subassembly after bottom surface 116 thereof has been conveniently ground or machined to a flat condition. Likewise, peripheral side edge 118 is machined or otherwise processed to be generally normal to bottom surface 116. Thereafter, the subassembly may be conveniently bonded to an associated substrate using those diffusion bonding techniques hereinabove previously described.

While the invention has been specifically described with reference to fabricating a laser mirror from a cemented tungsten carbide, it should be readily appreciated by those skilled in the art that the new diffusion bonding system has far broader applications and may be used in bonding any number of different types and configurations of components to each other to define a completed workpiece or part or some subassembly therefor. Moreover, it will also be appreciated that the type of material involved is not limited to cemented tungsten carbide but indeed, it is considered to be applicable to many types of liquid phase systems which include low melting phase components and high melting phase components. The specific operational parameters for the bonding process necessarily vary as between such materials, but generally fall in the range of those utilized for sintering such materials.

The invention has been described with reference to preferred and alternative embodiments. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. A method for diffusion bonding at least a pair of bodies to each other at a bond zone defined at the interface of cooperating surfaces of said bodies disposed in a contacting relationship with each other and wherein each of said bodies is formed of a cemented tungsten carbide material which includes cobalt as a low melting phase component and tungsten carbide as a high melting phase component, said method comprising the steps of:

sintering each of said bodies in an inert atmosphere to a temperature intermediate the melting temperature of said low and high melting phase components thereof to obtain substantially the full density and hardness characteristics for said bodies;

shaping said bodies to have substantially the desired conformations with one of said bodies having a first bond surface and the other of said bodies having a second bond surface, said first and second bond surfaces adapted to substantially mate with each other;

placing said first and second bodies in an assembled relationship with each other so that said first and second bond surfaces are in engagement and define said bond zone; and, heating said bodies in said assembled condition in an inert atmosphere to a temperature intermediate the melting temperatures of the low and high melting phase components thereof for causing grains in said first and second bodies at least adjacent said first and second bond surfaces to grow across said bond zone and thereby effect an integral interconnection between said bodies.

2. The method as defined in claim 1 further including the step of applying pressure to said bodies at least during said step of heating for continuously urging said first and second bond surfaces toward close mating engagement with each other.

3. The method as defined in claim 1 further including the step of treating at least one exposed surface of said assembled bodies to have a desired surface finish following said step of heating.

4. A method for joining at least a pair of members compacted from cemented carbide materials which include cobalt as a low melting phase component and tungsten carbide as a high melting phase component and wherein each member has been sintered in order to substantially obtain the full density of hardness characteristics thereof, said method comprising the steps of:

preparing a first joining surface on one of said members and a second joining surface on the other of said members so that said first and second joining surfaces are adapted to substantially mate with each other;

positioning said members in an assembled relationship with each other with a first joining surface of one member in engagement with a second joining surface of the other member for defining a boundary zone; and, heating said members in said assembled relationship in an inert atmosphere to a temperature intermediate the melting temperatures of said low and high melting phase components for causing coalescence of said members across said boundary zone and effecting integral interconnection between said members.

5. The method as defined in claim 4 further including the step of applying pressure to said members at least during said step of heating for continuously urging said first and second joining surfaces toward close mating engagement with each other.

6. The method as defined in claim 4 further including the step of preparing at least said first and second joining surfaces prior to said step of positioning so that said joining surfaces will closely mate with each other in said assembled relationship.

7. The method as defined in claim 6 including machining any desired conformation into said members during said step of preparing.

8. A method for bonding at least a pair of components to each other at some predetermined boundary therebetween so that said components become substantially integral with each other wherein said components are each formed from a cemented carbide material which has been compressed into some predetermined configuration and thereafter sintering to substantially obtain the full density and strength characteristics thereof, said method comprising the steps of:

shaping said components to generally have the final desired conformation therefor with one of said components having a first bonding surface and the other of said components having a second bonding surface, said first and second bonding surfaces being finished to accommodate selective placement thereof in a close mating relationship with each other;

placing said components in an assembled condition wherein said first and second bonding surfaces closely matingly engage and define said boundary; and, heating said components in said assembled condition in an inert atmosphere to a temperature within the range of sintering temperatures for said cemented carbide material for causing grains in each of said components adjacent said first and second bonding surfaces to grow across said boundary and effect an integral component interconnection.

9. The method as defined in claim 8 further including the step of applying pressure to said components at least during said step of heating for continously urging said first and second bonding surfaces toward close mating engagement with each other.

10. The method as defined in claim 8 wherein said step of shaping further includes locating at least one of said components on a mold surface having some predetermined desired conformation, causing at least said one component to be heated to a temperature within the range of its sintering temperatures to effect softening thereof and allowing said one component to assume the conformation of said mold surface.

11. The method as defined in claim 8 wherein said cemented carbide material comprises tungsten carbide and at least said heating step is performed at a temperature generally in the range of 1380° C.–1480° C. in a vacuum environment of less than 750 microns at said temperature.

12. The method as defined in claim 11 further including the step of positioning a weight on said components in said assembled condition for continuously urging said first and second bonding surfaces toward close mating engagement during said step of heating, said weight generally being less than 480 gms./in$^2$ of surface area at said boundary.

* * * * *